US010260790B2

(12) United States Patent
Hottenroth et al.

(10) Patent No.: US 10,260,790 B2
(45) Date of Patent: Apr. 16, 2019

(54) REFRIGERATOR APPLIANCE HAVING AN ICE STORAGE BIN

(71) Applicant: Haier US Appliance Solutions, Inc., Wilmington, DE (US)

(72) Inventors: Marc Eric Hottenroth, Crestwood, KY (US); Lauren Nicole Platts, Louisville, KY (US)

(73) Assignee: Haier US Applicance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/624,747

(22) Filed: Jun. 16, 2017

(65) Prior Publication Data

US 2018/0363966 A1 Dec. 20, 2018

(51) Int. Cl.

| | |
|---|---|
| ***F25C 5/20*** | (2018.01) |
| ***F25D 27/00*** | (2006.01) |
| ***F25D 23/04*** | (2006.01) |
| ***F25D 23/02*** | (2006.01) |

(52) U.S. Cl.

CPC ..... *F25C 5/22* (2018.01); *F25D 23/028* (2013.01); *F25D 23/04* (2013.01); *F25D 27/005* (2013.01); *F25D 2323/023* (2013.01); *F25D 2700/02* (2013.01)

(58) Field of Classification Search

CPC ..... F25C 5/22; F25D 23/028; F25D 23/04; F25D 23/02; F25D 23/025; F25D 27/005; F25D 2323/023; F25D 2700/02

USPC ..... 62/448, 441, 344

See application file for complete search history.

(56) References Cited

U.S. PATENT DOCUMENTS

| | | | | |
|---|---|---|---|---|
| 8,312,735 | B2 * | 11/2012 | Fulton | F25C 5/187 62/344 |
| 8,745,992 | B2 * | 6/2014 | Cheong | F25D 23/025 62/3.3 |
| 8,875,538 | B2 | 11/2014 | Lee et al. | |
| 2012/0103001 | A1 * | 5/2012 | Krause | G02B 6/0008 62/389 |
| 2014/0202197 | A1 * | 7/2014 | Anselmino | F25C 5/22 62/344 |
| 2015/0260447 | A1 * | 9/2015 | Kim | F25D 27/005 312/405 |
| 2017/0299257 | A1 * | 10/2017 | Wantland | F21V 33/0044 |

FOREIGN PATENT DOCUMENTS

| | | | |
|---|---|---|---|
| WO | WO2017016767 | A1 | 2/2017 |

* cited by examiner

*Primary Examiner* — Joseph F Trpisovsky
(74) *Attorney, Agent, or Firm* — Dority & Manning, P.A.

(57) ABSTRACT

A refrigerator appliance having an ice storage bin is generally provided herein. A door may define a bin opening and a dispenser recess to a cabinet of the refrigerator appliance. A dispensing assembly may be positioned within the dispenser recess and define an ice delivery passage. The ice storage bin may define a storage cavity in selective communication with an icemaker to receive ice therefrom. The ice storage bin may be in further communication with the dispensing assembly to direct ice to the ice delivery passage. The ice storage bin may be mounted to the door and selectively accessible through the bin opening.

18 Claims, 10 Drawing Sheets

REFRIGERATOR APPLIANCE HAVING AN ICE STORAGE BIN

FIELD OF THE INVENTION

The present subject matter relates generally to refrigerator appliances, and more particularly to refrigerator appliances having a selectively accessible ice storage bin.

BACKGROUND OF THE INVENTION

Refrigerator appliances generally include a cabinet that defines one or more chilled chambers for receipt of food articles for storage. In addition, refrigerator appliances also generally include a door rotatably hinged to the cabinet to permit selective access to food items stored in chilled chamber(s). Certain refrigerator appliances, commonly referred to as door-in-door refrigerator appliances, may include an outer door rotatably hinged to an inner door to permit selective access to the chilled chamber(s) or, alternatively, a food storage chamber positioned between the inner and outer doors. Further refrigerator appliances include an icemaker. In order to produce ice, liquid water is directed to the icemaker and frozen. After being frozen, ice may be directed to a separate ice storage bin. In order to maintain ice in a frozen state, the ice storage bin is positioned within one of the chilled chambers and/or a separate compartment behind one of the doors. In the case of a door in door-in-door refrigerator appliance, the ice storage bin may be positioned behind both of the inner and outer doors.

Although the ice storage bin of a refrigerator appliance may be accessible to a user, such access generally requires opening the door(s) to the chilled chamber. Thus, if a user wishes to draw ice directly from the ice storage bin, relatively hot ambient air will be introduced to the chilled chamber. The introduction of ambient air may greatly increase the temperature within the chilled chamber and reduce the overall efficiency of the refrigerator appliance. Some systems may provide a dispenser assembly in the door to direct ice from the icemaker or ice storage bin to an area outside of the refrigerator appliance. However, such a dispenser assembly may clutter the outer appearance of the refrigerator appliance, detracting from the visual appeal and creating surfaces that may be accidentally activated or damaged.

Similar, if not greater concerns, may arise if a user simply wishes to view the contents of the ice storage bin (e.g., to see how much ice is currently stored within the ice storage bin). A user is generally required to open the door of the refrigerator appliance to view of the ice storage bin. Moreover, since the contents of many ice storage bins are not readily visible, even when door to chilled chamber is open, a user may be required to remove the ice storage bin in order to view its contents.

Accordingly, it would be advantageous to provide a refrigerator appliance with feature(s) addressing one or more of the above-identified issues.

BRIEF DESCRIPTION OF THE INVENTION

Aspects and advantages of the invention will be set forth in part in the following description, or may be obvious from the description, or may be learned through practice of the invention.

In one aspect of the present disclosure, a refrigerator appliance is provided. The refrigerator appliance may include a cabinet defining a chilled chamber, a door, a dispensing assembly, an icemaker, and an ice storage bin. The door may define a bin opening and a dispenser recess. The door may be rotatably hinged to the cabinet to rotate between a closed position restricting access to the chilled chamber and an open position permitting access to the chilled chamber. The dispensing assembly may be positioned within the dispenser recess and define an ice delivery passage. The icemaker may be attached to the cabinet. The ice storage bin may define a storage cavity in selective communication with the icemaker to receive ice therefrom. The ice storage bin may be in further communication with the dispensing assembly to direct ice to the ice delivery passage. The ice storage bin may be mounted to the door at the bin opening. The ice storage bin may be selectively accessible through the bin opening in the closed position.

In another aspect of the present disclosure, a refrigerator appliance is provided. The refrigerator appliance may include a cabinet defining a chilled chamber, an inner door, an outer door, a dispensing assembly, an icemaker, and an ice storage bin. The inner door may define a bin opening and a dispenser recess. The inner door may be rotatably hinged to the cabinet to rotate between a closed position restricting access to the chilled chamber and an open position permitting access to the chilled chamber. The outer door may be rotatably hinged to the inner door to rotate between a covered position restricting access to the dispenser recess in the closed position of the inner door and an uncovered position permitting access to the dispenser recess in the closed position of the inner door. The dispensing assembly may be positioned within the dispenser recess and defining an ice delivery passage. The icemaker may be attached to the cabinet. The ice storage bin may define a storage cavity in selective communication with the icemaker to receive ice therefrom. The ice storage bin may be in further in communication with the dispensing assembly to direct ice to the ice delivery passage. The ice storage bin may be mounted to the inner door at the bin opening. The ice storage bin may be selectively accessible through the bin opening.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
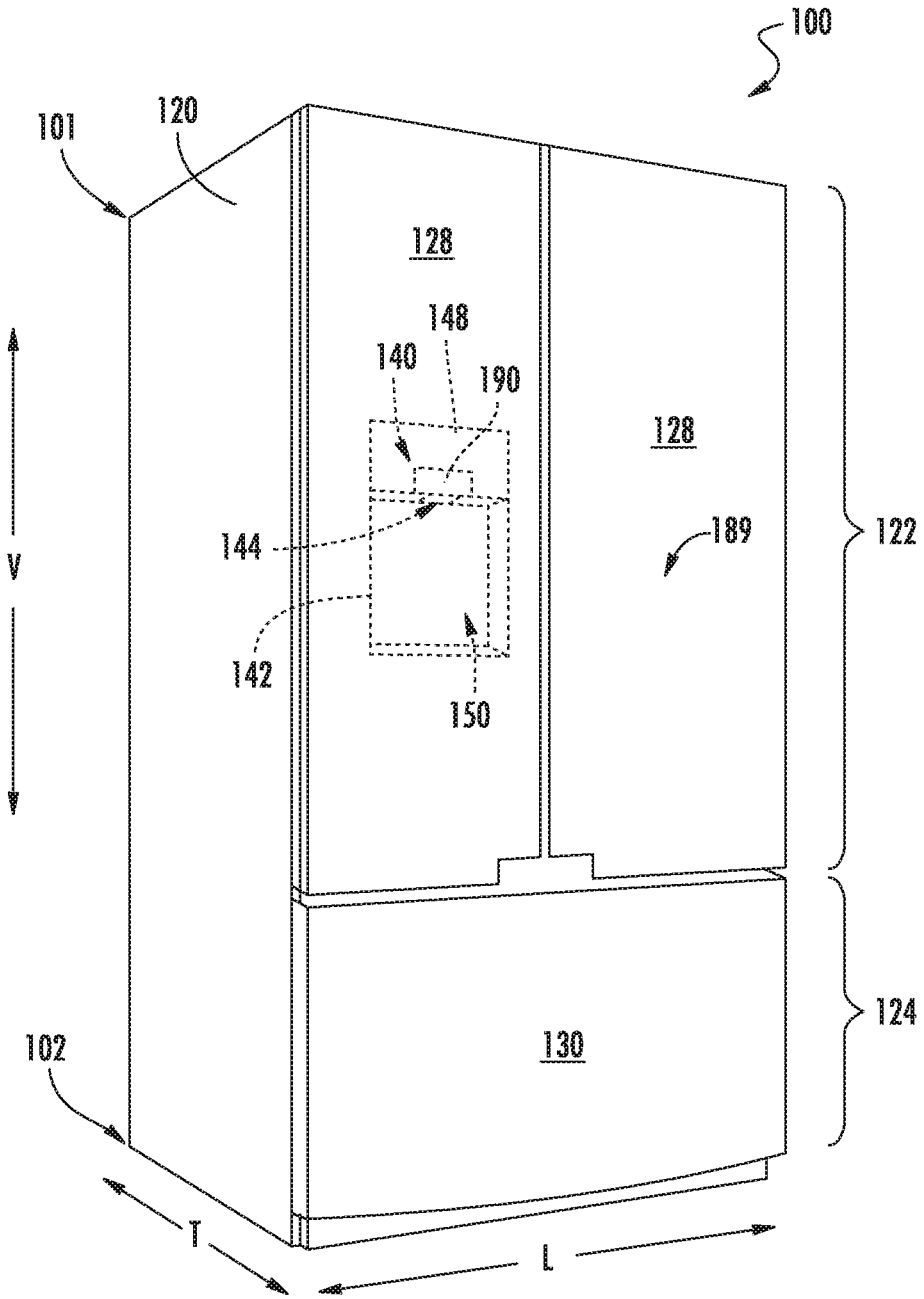
FIG. 1 provides a perspective view of a refrigerator appliance according to example embodiments of the present disclosure, wherein refrigerator doors are shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
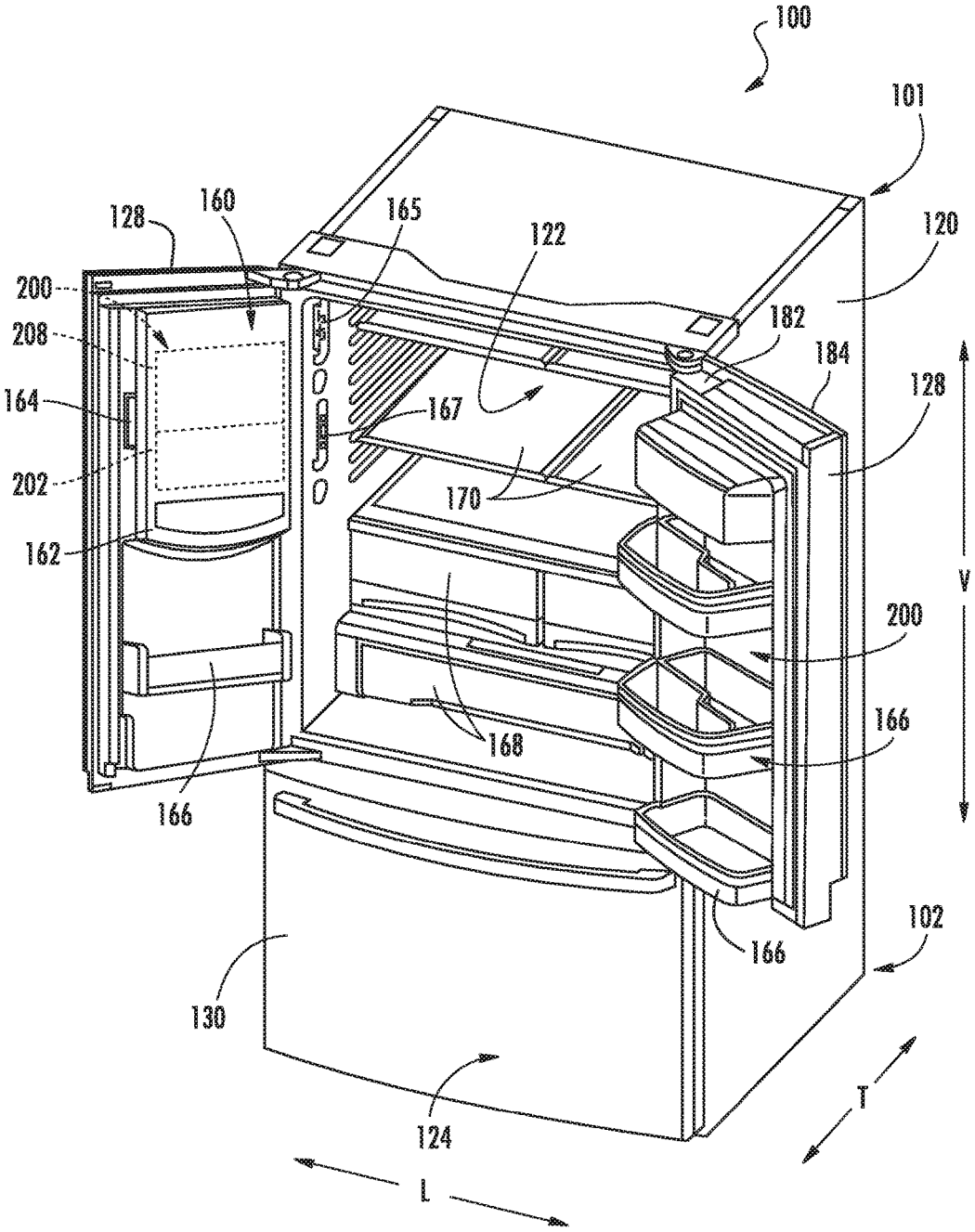
FIG. 2 provides a perspective view of the example refrigerator appliance of FIG. 1, wherein refrigerator doors are shown in an open position to reveal a fresh food chamber.

Referring now to the drawings, FIGS. 1 and 2 provide perspective views of a refrigerator appliance 100 according to example embodiments of the present disclosure. Generally, FIG. 1 provides a pair of refrigerator doors 128 in a closed position, while FIG. 2 provides refrigerator doors 128 in an open position.

Refrigerator appliance 100 includes a cabinet or housing 120 that extends between a top 101 and a bottom 102 along a vertical direction V. Cabinet 120 also extends along a lateral direction L and a transverse direction T, each of the vertical direction V, lateral direction L, and transverse direction T being mutually perpendicular to one another. Cabinet 120 defines chilled chambers for receipt of food items for storage. In particular, cabinet 120 defines a fresh food chamber 122 positioned at or adjacent top 101 of cabinet 120 and a freezer chamber 124 arranged at or adjacent bottom 102 of cabinet 120. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

According to the illustrated embodiment, various storage components are mounted within fresh food chamber 122 to facilitate storage of food items therein, as will be understood by those skilled in the art. In particular, the storage components include storage bins 166, drawers 168, and shelves 170 that are mounted within fresh food chamber 122. Storage bins 166, drawers 168, and shelves 170 are configured for receipt of food items (e.g., beverages and/or solid food items) and may assist with organizing such food items. As an example, drawers 168 can receive fresh food items (e.g., vegetables, fruits, and/or cheeses) and increase the useful life of such fresh food items.

Refrigerator doors 128 are rotatably hinged to an edge of cabinet 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

Figure 3:
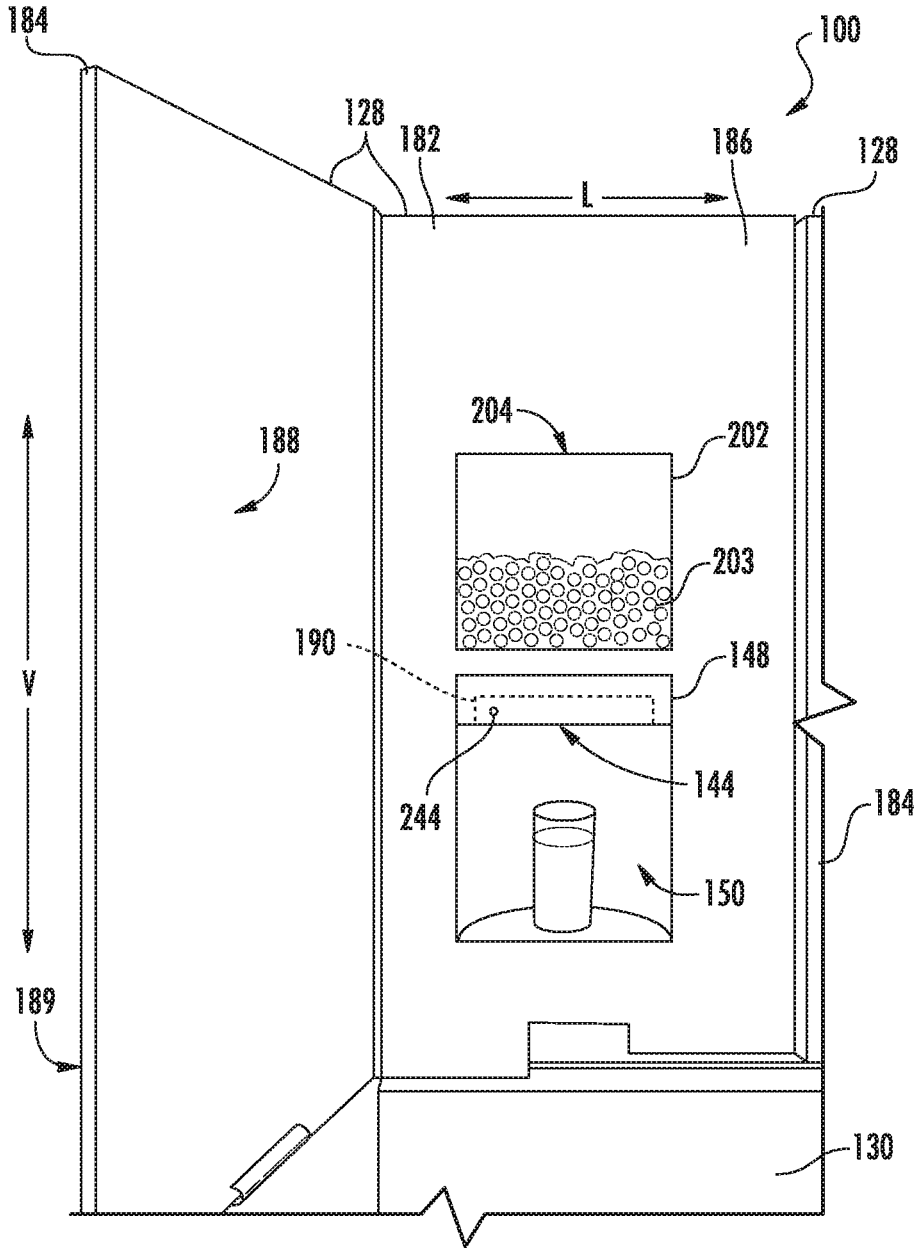
FIG. 3 provides a perspective view of a dispensing assembly of the example refrigerator appliance of FIG. 1, wherein an outer refrigerator door is shown in an uncovered position.

Turning now to FIGS. 1 through 3, FIG. 3 further provides a magnified perspective view of a portion refrigerator appliance 100. As shown, in some embodiments, refrigerator appliance 100 is provided as a door-in-door appliance. In turn, at least one of refrigerator doors 128 includes a discrete inner door 182 and outer door 184. Generally, inner door 182 rotates to between a closed position (e.g., FIGS. 1 and 3) and open position (e.g., FIG. 2). Inner door 182 may include an external panel 186 that generally faces away from fresh food chamber 122 and toward outer door 184. Outer door 184 may further include an internal surface 188 (e.g., planar surface) that is disposed across the external panel 186 in the covered position. Additionally or alternatively, a smooth or solid external surface 189 of outer door 184 may be defined opposite of the internal surface 188. In turn, external surface 189 may provide a clean protective aesthetic when outer door 184 is in the covered position.

Outer door 184 is rotatably attached to inner door 182 to move between an independent covered position (e.g., FIGS. 1 and 2) and uncovered position (e.g., FIG. 3). When assembled, outer door 184 may be generally held in the covered position by a suitable selective fastener. For example, a mechanical or magnetic fastener (not pictured) may selectively secure outer door 184 to inner door 182 (e.g., with greater than 15 pounds of attractive force). Thus, during some uses, outer door 184 may rotate with inner door 182. However, upon release of the outer door 184 from inner door 182 (e.g., by a separate release mechanism or a force greater than 15 pounds), outer door 184 may rotate independently from inner door 182 (e.g., to the uncovered position).

Figure 9:
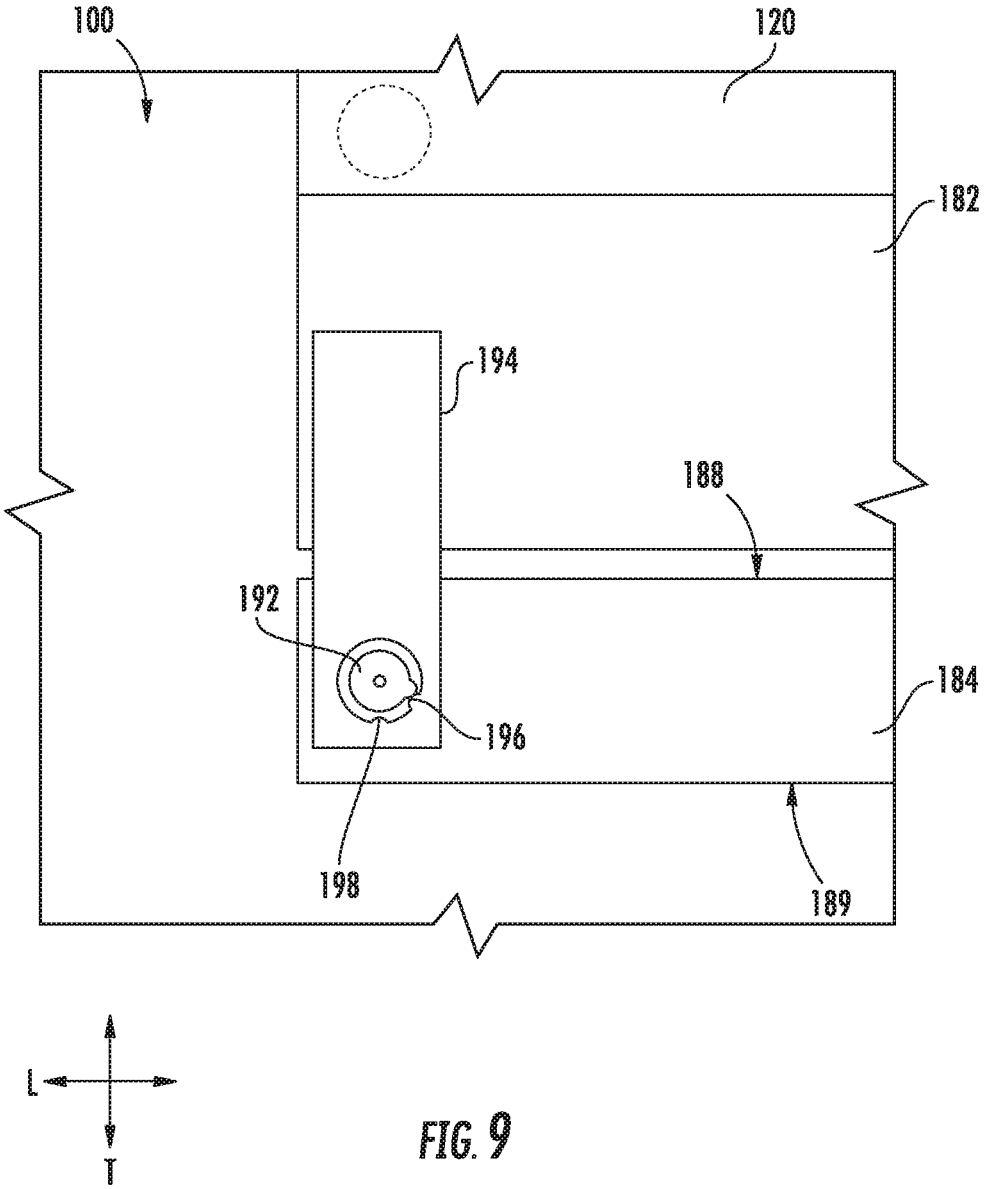
FIG. 9 provides a magnified, top schematic view of a portion of the example refrigerator appliance of FIG. 1, wherein an outer door is in a covered position.
Figure 10:
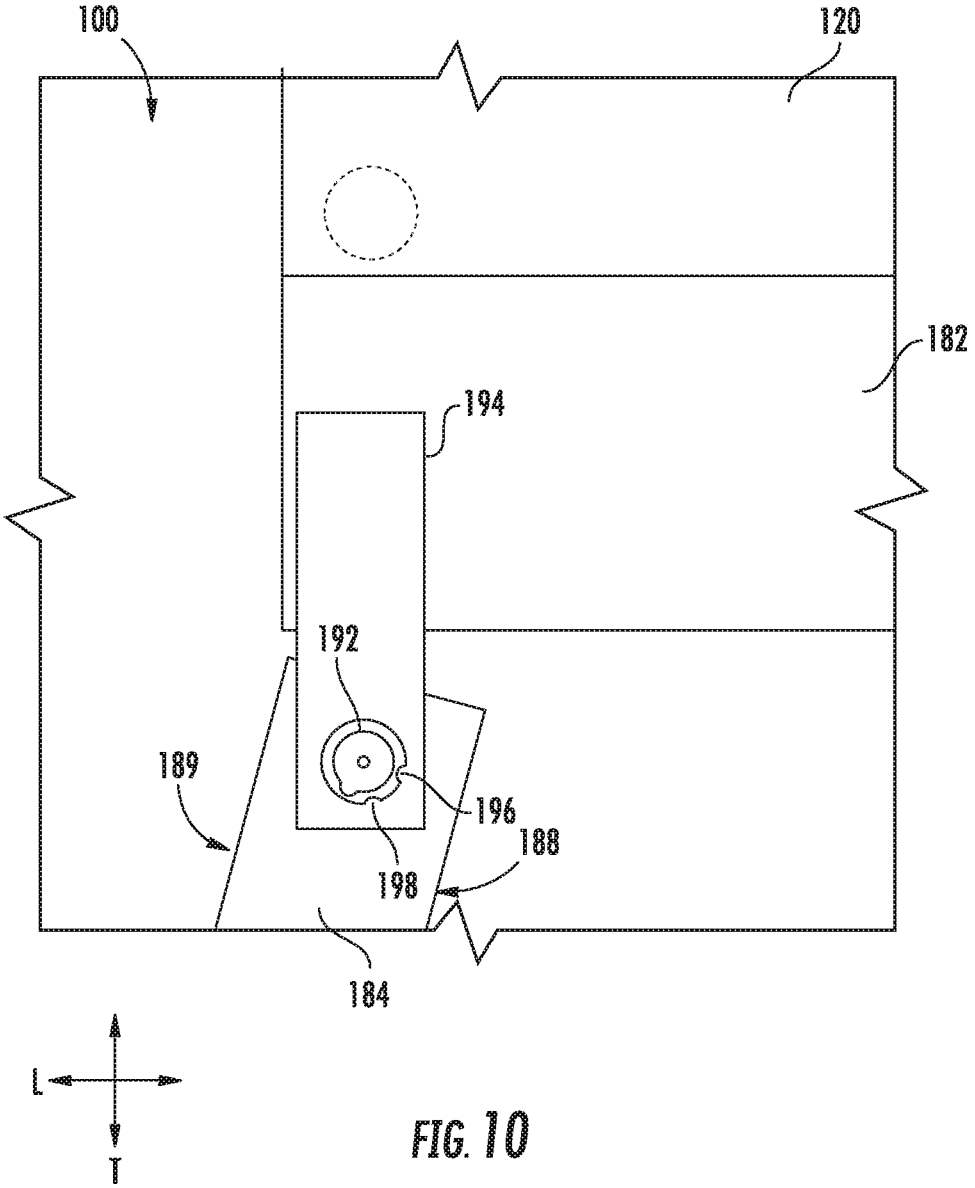
FIG. 10 provides a magnified, top schematic view of a portion of the example refrigerator appliance of FIG. 1, wherein an outer door is in an uncovered position.

Turning briefly to FIGS. 9 and 10, two top (i.e., overhead) schematic views are provided of an optional hinge assembly connecting a door 128 to the cabinet 120. As shown, inner door 182 may be pivotally mounted on cabinet 120 while outer door 184 is pivotally mounted on inner door 182. Generally, FIGS. 9 and 10 illustrate movement of outer door 184 between a covered position (FIG. 9) and an uncovered position (FIG. 10). In some embodiments, a rotatable cam 192 and mounting bracket 194 join outer door 184 to inner door 182. One or more detents 196, 198 may be defined between rotatable cam 192 and mounting bracket 194 to engage a radial surface of rotatable cam 192. In turn, rotatable cam 192 may engage the detents 196, 198 as outer door 184 is rotated between covered position and uncovered position. Optionally, multiple detents 196, 198 may be provided at discrete circumferential positions to hold or bias outer door 184 at unique rotational positions relative to inner door 182. For instance, one detent 196 may hold outer door 184 at the covered position (e.g., parallel to inner door 182). Another detent 198 may hold outer door 184 at the uncovered position (e.g., at a predetermined non-parallel angle relative to inner door 182).

Returning to FIGS. 1 through 3, in come embodiments, refrigerator appliance 100 includes a dispensing assembly 140 for dispensing liquid water and/or ice. For instance, dispensing assembly 140 may be mounted to inner door 182 and/or behind outer door 184. Dispensing assembly 140 includes a dispenser 142 positioned on or mounted to one of refrigerator doors 128. Dispenser 142 includes a discharging outlet 144 for accessing ice and liquid water. In certain embodiments, an actuating mechanism may be mounted on inner door 182. Generally, any suitable actuating mechanism may be used to operate dispenser 142. For example, dispenser 142 can include a sensor (such as an ultrasonic sensor) or a button. Alternatively, a paddle may be mounted within a dispenser recess 150 below discharging outlet 144.

Generally, dispensing assembly 140, including discharging outlet 144, is provided on the external panel 186 of inner door 182. Specifically, discharging outlet 144 is an external part of dispensing assembly 140 mounted in a dispenser recess 150. As shown, dispenser recess 150 is defined in inner door 182 at the external panel 186. When outer door 184 is in the closed position, dispenser recess 150 may thus be covered (e.g., by external surface 189 and internal surface 188 along the transverse direction T). Optionally, dispenser recess 150 is positioned at a predetermined elevation convenient for a user to access ice or water and enabling the user to access ice without the need to bend-over and without the need to open inner door 182. During use, outer door 184 may thus be rotated into the uncovered position, permitting immediate access to dispensing assembly 140 while inner door 184 remains in the closed position.

A control panel or user interface 148 may be provided for directing or selecting certain operations of dispensing assembly 140. For example, user interface 148 may be mounted on the external panel of inner door 182 (e.g., behind outer door 184). In some embodiments, user interface 148 includes a plurality of user inputs (not labeled), such as a water dispensing button and an ice-dispensing button, for selecting a desired mode of operation such as crushed or non-crushed ice.

As will be discussed below, refrigerator appliance 100 may include an ice making assembly 200 in communication (e.g., physical communication, fluid communication, etc.) with dispensing assembly 140. For instance, an ice storage bin 202 may be mounted above discharging outlet 144 to direct ice 203 thereto. In certain embodiments, inner door 182 defines a bin opening 204 through external panel 186 to receive the ice storage bin 202 in the closed position. A bin compartment 206 extending from the bin opening 204 may be defined within inner door 182 to further receive and house the ice storage bin 202 in the closed position. When assembled, outer door 184 may thus be selectively disposed across bin opening 204.

In some embodiments, ice making assembly 200 includes an icemaker 208 attached to cabinet 120. For instance, icemaker 208 may be attached to one of doors 128 (e.g., within the corresponding inner door 182). In some such embodiments, at least one door 128 includes a door liner 132 defining a sub-compartment, e.g., icebox compartment 160. Icebox compartment 160 extends into fresh food chamber 122 when inner door 182 is in the closed position. Although icebox compartment 160 is shown in door 128, additional or alternative embodiments may include an icebox compartment 160 fixed within fresh food chamber 122. Ice may be supplied to dispenser recess 150 from ice making assembly 200 in icebox compartment 160 on a back side of refrigerator door 128.

An access door—e.g., icebox door 162—may be hinged to icebox compartment 160 to selectively cover or permit access to opening of icebox compartment 160. Icebox door 162 permits selective access to icebox compartment 160. Any manner of suitable latch 164 is provided with icebox compartment 160 to maintain icebox door 162 in a closed position. As an example, latch 164 may be actuated by a consumer in order to open icebox door 162 for providing access into icebox compartment 160. Icebox door 162 can also assist with insulating icebox compartment 160, e.g., by thermally isolating or insulating icebox compartment 160 from fresh food chamber 122. Icebox compartment 160 may receive cooling air from a chilled air supply duct 165 and a chilled air return duct 167 disposed on a side portion of cabinet 102 of refrigerator appliance 100. In this manner, the supply duct 165 and return duct 167 may recirculate chilled air from a suitable sealed cooling system through icebox compartment 160. An air handler (not pictured), such as a fan or blower, may be provided to motivate and recirculate air. As an example, the air handler can direct chilled air from an evaporator of a sealed system through a duct to compartment 160.

Operation of the refrigerator appliance 100 can be generally controlled or regulated by a controller 190. In some embodiments, controller 190 is operably coupled to user interface 148, ice making assembly 200, and/or various other components, as will be described below.

Controller 190 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In some embodiments, the processor executes non-transitory programming instructions stored in memory. For certain embodiments, the instructions include a software package configured to operate appliance 100. The memory may be a separate component from the processor or may be included onboard within the processor. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 190, or portions thereof, may be positioned in a variety of locations throughout refrigerator appliance 100. In example embodiments, controller 190 is located within the user interface 148. In other embodiments, the controller 190 may be positioned at any suitable location within refrigerator appliance 100, such as for example within fresh food chamber 122, a freezer door 130, etc. In additional or alternative embodiments, controller 190 is formed from multiple components mounted at discrete locations within or on refrigerator appliance 100. Input/output ("I/O") signals may be routed between controller 190 and various operational components of refrigerator appliance 100. For example, user interface 148 and/or ice making assembly 200 may be operably coupled (e.g., electrically coupled, wirelessly coupled, etc.) to controller 190 via one or more signal lines (e.g., conductive wires or wireless transmission bands) or shared communication busses.

Turning now to FIGS. 4 through 7, various schematic views of a portion of door 128, including an ice storage bin 202 are provided. As shown, ice storage bin 202 generally includes a plurality of walls 210, 212 defining a storage cavity 214. For instance, ice storage bin 202 may include one or more sidewalls 210 and a base wall 212, which may together define storage cavity 214. Together, the sidewalls 210 define an opening perimeter 216 at a top portion (e.g., vertical extreme opposite the base wall 212) of container ice storage bin 202. As shown, opening perimeter 216 may permit access to storage cavity 214, e.g., to add or remove ice 203 (FIG. 3) therein. In turn, the storage cavity 214 may be in communication (e.g., selective physical communication, fluid communication, etc.) with icemaker 208 to receive ice therefrom. In specific embodiments, icemaker 208 is mounted above bin opening 204 and/or bin compartment 206 along the vertical direction V. Thus, icemaker 208 may be positioned above storage bin 202 (e.g., over the opening perimeter 216).

In example embodiments, at least one sidewall 210 may be formed from a clear, see-through (i.e., transparent or translucent) material, such as a clear glass or plastic, such that a user can see into storage cavity 214 and thus view ice therein. For instance, at least one sidewall 210 may include a front panel 218 and/or a rear panel 220 formed from a clear, see-through (i.e., transparent or translucent) material, such as a clear glass or plastic.

In additional or alternative embodiment, ice storage bin 202 includes at least one insulated sidewall 210, e.g., adjacent external panel 186 of inner door 182. In some such embodiments, when ice storage bin 202 is inserted into bin opening 204 and bin compartment 206, the insulated sidewall 210 is positioned across bin opening 204. As shown, insulated sidewall 210 includes a front panel 218 and a rear panel 220. Each of front panel 218 and rear panel 220 extend from base wall 212. In some such embodiments, base wall 212 is positioned below a portion of insulated sidewall 210 such that base wall 212 is beneath the rear panel 220 along the vertical direction V. Optionally, each of front panel 218 and rear panel 220 extend vertically from base wall 212 to a top portion of ice storage bin 202. Front panel 218 and rear panel 220 are spaced apart, e.g., in the transverse direction T at base wall 212. A roof segment 222 may span the distance between front panel 218 and rear panel 220 at the top portion of ice storage bin 202, e.g., above a transparent insulation gap 224.

In some embodiments, a transparent insulation gap 224 is defined between front panel 218 and rear panel 220. For instance, transparent insulation gap 224 may be provided as a sealed volume. The sealed volume may generally prevent the passage of air or oxygen to or from transparent insulation gap 224. In example embodiments, transparent insulation gap 224 is substantially evacuated as a vacuum. In alternative example embodiments, transparent insulation gap 224 is filled with a set mass of a predetermined gas, such as nitrogen, oxygen, argon, or a suitable inert gas.

Figure 4:
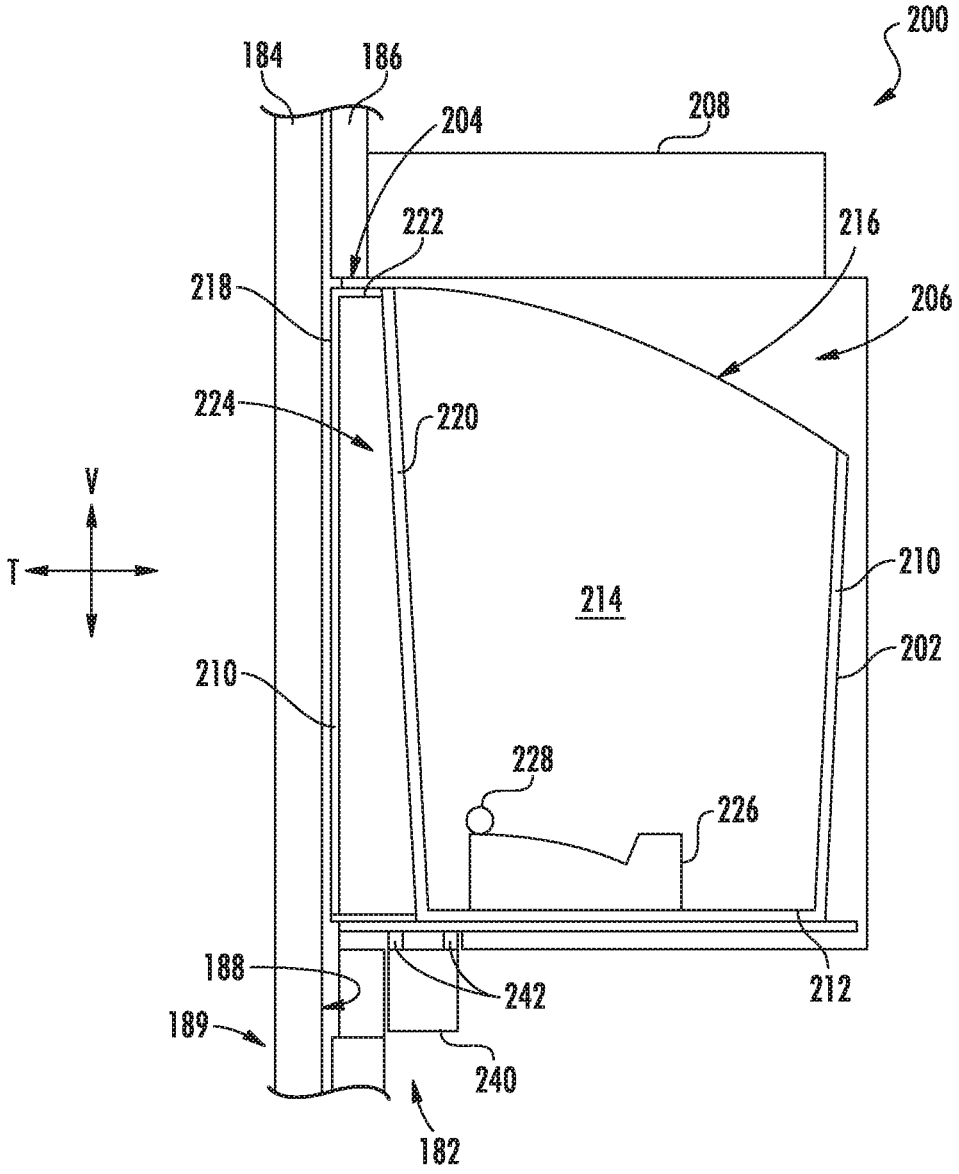
FIG. 4 provides a side schematic view of an ice making assembly of a refrigerator appliance in accordance with example embodiments of the present disclosure.
Figure 5:
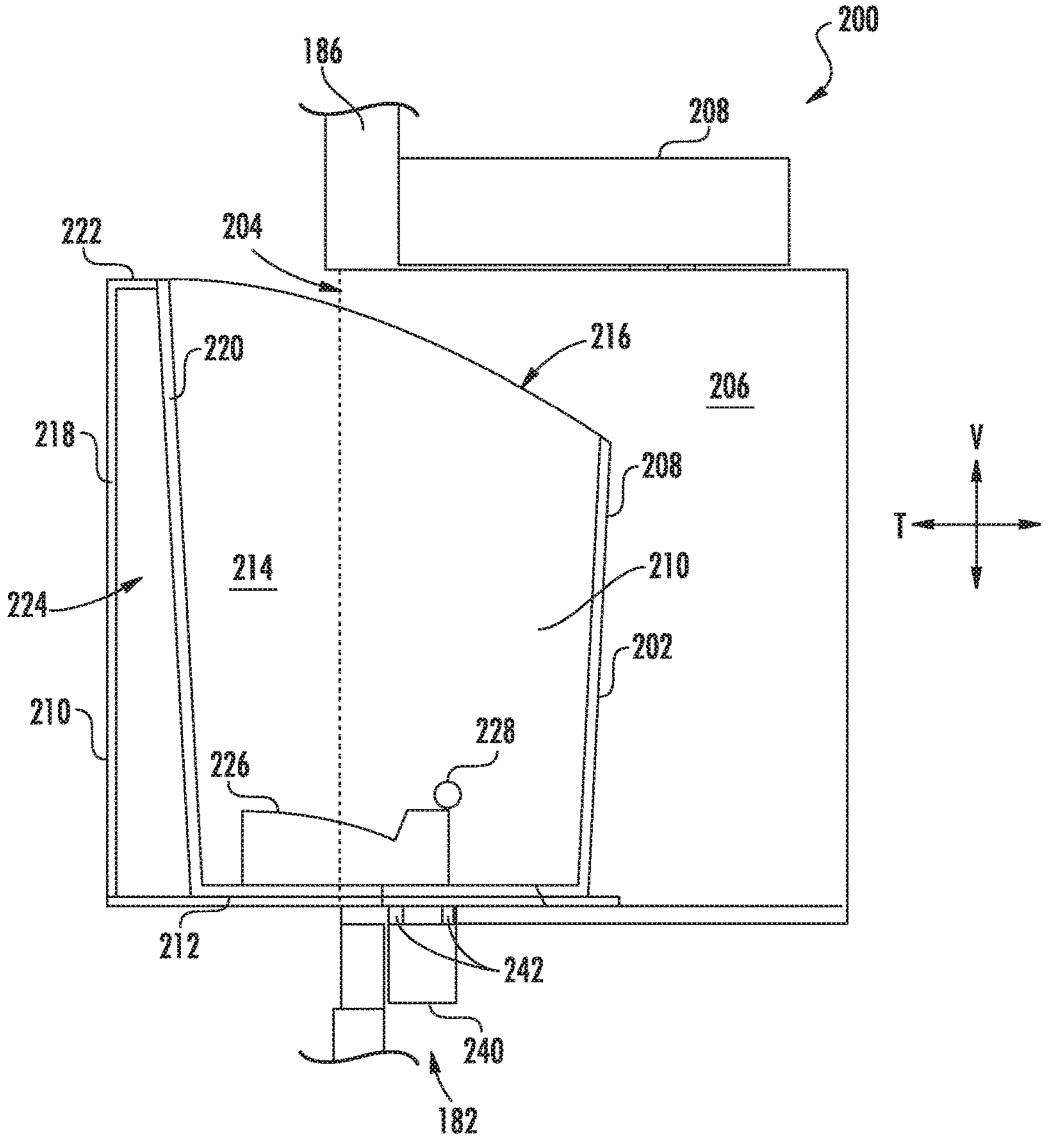
FIG. 5 provides a side schematic view of the example ice making assembly of FIG. 4, wherein the ice storage bin is moved away from a limiting position.
Figure 6:
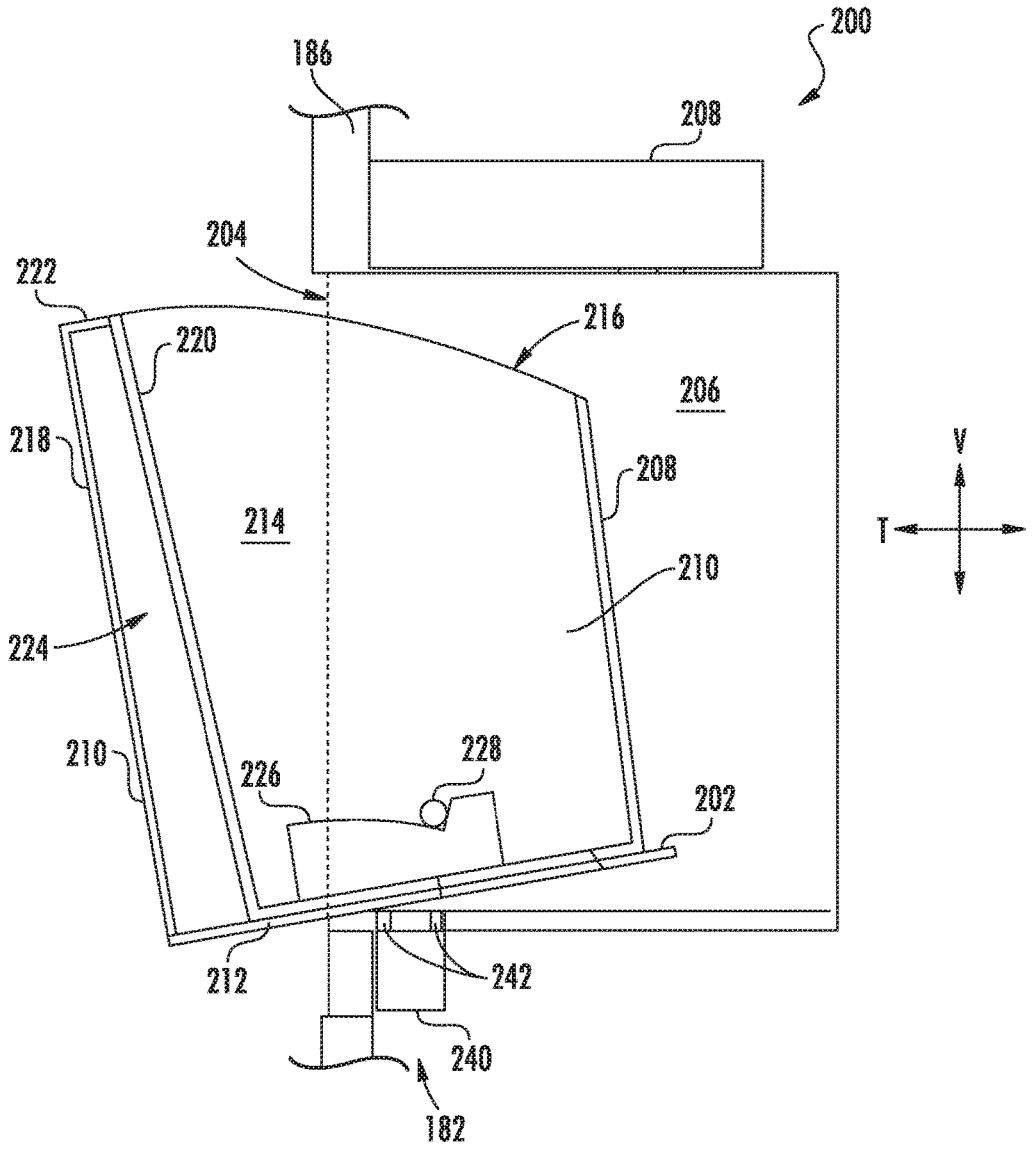
FIG. 6 provides a side schematic view of the example ice making assembly of FIG. 4, wherein the ice storage bin is pivoted away from a limiting position.

As illustrated in FIGS. 4 through 6, ice storage bin 202 may be movably and/or removably attached to a portion of refrigerator appliance 100. For instance, ice storage bin 202 may be mounted to inner door 182 and moveable between a limiting position (e.g., FIG. 4) and one or more ajar positions (e.g., FIGS. 5 and 6). Generally, the limiting position may restrict user access to storage cavity 214 (e.g., through the opening perimeter 216) while the ajar position(s) may permit access to storage cavity 214 (e.g., through the opening perimeter 216). In other words, ice storage bin 202 is mounted to be selectively accessible on or within inner door 182.

In certain embodiments, the limiting position will provided ice storage bin 202 within bin compartment 206 such that front panel 218 extends across bin opening 204, thereby blocking bin opening 204 (e.g., user access to or through bin opening 204). In the covered position, outer door 184 may extend over storage cavity 214 (e.g., along the transverse direction T) and generally block direct user access thereto. Icemaker 208 may be in communication with storage cavity 214 in the limiting position such that ice may be directed thereto. In additional or alternative embodiments, the ajar position(s) provide at least a portion of ice storage bin 202 outside of inner door 182. At least a portion of ice storage bin 202 may remain on or within inner door 182 (e.g., through bin opening 204). Thus, at least a portion of storage cavity 214 is accessible to receive, for instance, a scoop or user's hand. This may facilitate easy access to ice within the ice storage bin 202, such as when outer door 184 is in the uncovered position and inner door 182 is in the closed position, as illustrated in FIGS. 5 and 6. Advantageously, ice storage bin 202 may be accessed without exposing fresh food chamber 122 (FIG. 2) to ambient air. Moreover, outer door 184 may be able to advantageously block and/or further insulate ice storage bin 202 when outer door 184 is in the covered position, as illustrated in FIG. 4.

In specific embodiments, storage bin 202 is slidably attached to inner door 182. Storage bin 202 may thus slide from the limiting position (FIG. 4) to at least one ajar position (FIG. 5). In additional or alternative embodiments, storage bin 202 is pivotally attached to inner door 182. In turn, storage bin 202 may pivot to at least one ajar position (e.g., FIG. 6). Optionally, storage bin 202 may be completely removable from inner door 182.

A specific movable storage bin 202 is described below with respect to FIGS. 4 through 6. However, it is noted that any suitable embodiment may be provided to permit movement of the storage bin 202 relative to inner door 182, as described above.

As illustrated in FIGS. 4 through 6, storage bin 202 may be selectively moveable between various positions on or within refrigerator appliance 100 (FIG. 1). For instance, storage bin 202 may be selectively positionable in a distinct limiting position (FIG. 4), first ajar position (FIG. 5), and second ajar position (see FIG. 6). In the limiting position of FIG. 4, storage bin 202 may be considered fully received within bin opening 204 and bin compartment 206. A guide rail 226 mounted to at least one of sidewalls 210 (e.g., as lateral extreme of storage bin 202) may be positioned directly below a rail latch 228 extending laterally within bin compartment 206. In turn, rail latch 228 and guide rail 226 may restrict vertical or angular movement of storage bin 202. Base wall 212 may extend along a level plane, e.g., a plane that is parallel to transverse direction T and/or lateral direction L.

In the first ajar position of FIG. 5, storage bin 202 extends at least partially outside of bin compartment 206 through bin opening 204. From the first ajar position, storage bin 202 may be further moved relative to (e.g., removed from) inner door 182. For instance, storage bin 202 may be removed by forward manual linear movement of the storage bin 202 in the transverse direction T away from internal bin opening 204. Moreover, from the first ajar position, storage bin 202 may be inserted further into inner door 182, such as to the limiting position. For instance, storage bin 202 may be moved to the limiting position by rearward manual linear movement of the storage bin 202 in the transverse direction T toward internal bin compartment 206 through bin opening 204. In example embodiments, moving storage bin 202 from the limiting position to the first ajar position slides storage bin 202 forward in the transverse direction T, e.g., away from bin compartment 206. Moving storage bin 202 from the first ajar position to the limiting position slides storage bin 202 rearward in the transverse direction T, e.g., toward bin compartment 206. During forward and/or rearward movement, guide rail 226 slides below rail latch 228. Base wall 212 may remain along the same level plane as in the limiting position, e.g., a plane that is parallel to transverse direction T and/or lateral direction L.

In the second ajar position of FIG. 6, storage bin 202 is tilted away from bin compartment 206 through bin opening 204. The storage bin 202 defines a predetermined angle relative to the transverse direction T, e.g., at base wall 212, that is distinct from any angle that storage bin 202 defines in the limiting position. For instance, base wall 212 may extend along a new plane, e.g., a plane that is defined at the predetermined angle and is not parallel to transverse direction T and/or lateral direction L. In the second ajar position, an inclined tilt catch of guide rail 226 engages rail latch 228 (see also FIG. 9). Base wall 212 is balanced on a bottom edge of bin opening 204 while the mass of storage bin 202 urges it forward. Moving from the first ajar position to the second ajar position may require rotating storage bin 202 forward until the inclined tilt catch of guide rail 226 strikes rail latch 228 and is prevented from further rotation. Optionally, one or more of the sidewalls 210 are defined along a sloped edge (e.g., at a top portion of storage bin 202) that avoids contact with external panel 186 as storage bin 202 moves to or from the second ajar position.

Figure 7:
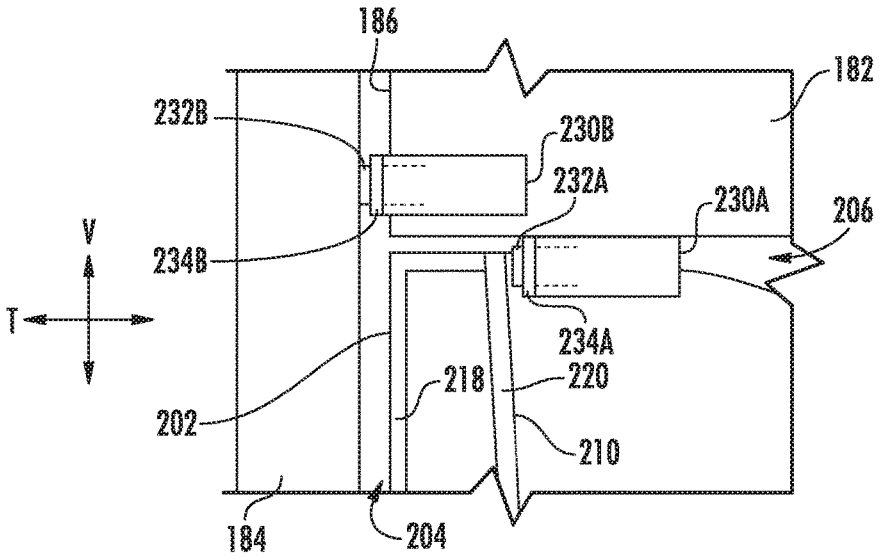
FIG. 7 provides a magnified, schematic view of a portion of the example assembly of FIG. 4.
Figure 8:
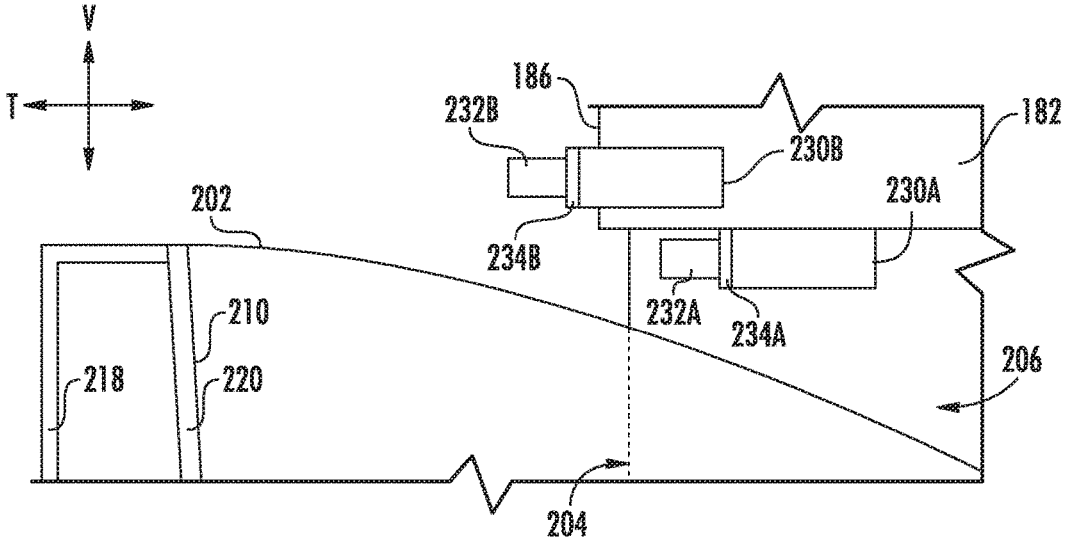
FIG. 8 provides a magnified, side schematic view of a portion of the example assembly of FIG. 5.

Turning briefly to FIGS. 7 and 8, two magnified schematic views are provided illustrating movement of ice storage bin 202 between a limiting position (FIG. 7) and an ajar position (FIG. 8). As shown, some embodiments may include one or more push-to-open latches 230A, 230B. For instance, a push-to-open latch 230A may be mounted on inner door 182 (e.g., within bin compartment 206) in operative communication (e.g., mechanical communication) with storage bin 202. A reciprocating plunger 232A may selectively cam between a retracted position (FIG. 7) and an extended position (FIG. 8). A magnetic element 234A may magnetically engage or hold the sidewall 210 [e.g., at a complementary magnetic element (not pictured) mounted to sidewall 210] in the retracted position such that the storage bin 202 is motivated toward the limiting position. By contrast, in the extended position, the plunger 232A may motivate storage bin 202 away from the limiting position. Pushing the plunger 232A 232B (e.g., along the transverse direction T through storage bin 202) may alternate the plunger 232A (e.g., via roto-translational movement) between the retracted and extended positions.

Additionally or alternatively, another push-to-open latch 230B may be mounted on inner door 182 (e.g., through external panel 186) in operative communication with outer door 184. A reciprocating plunger 232B may selectively cam between a retracted position (FIG. 7) and an extended position (FIG. 8). A magnetic element 234B may magnetically engage or hold the outer door 184 [e.g., at a complementary magnetic element (not pictured) mounted to outer door 184] in the retracted position such that outer door 184 is motivated toward the covered position. By contrast, in the extended position, the plunger 232B may motivate outer bin away from the covered position. Pushing the plunger 232B (e.g., along the transverse direction T through storage bin 202) may alternate the plunger 232B (e.g., via roto-translational movement) between the retracted and extended positions.

Returning to FIGS. 4 through 6, in optional embodiments, an illumination assembly 240 is mounted to inner door 182. As shown, illumination assembly 240 may include one or more light sources 242 that are mounted within or below the bin opening 204 and/or bin compartment 206. Light source 242 may include a suitable light-emitting element, such as one or more fluorescent bulbs or light emitting diodes (LEDs). Moreover, light source 242 may be directed toward storage cavity 214 (e.g., when storage bin 202 is in the limiting position). In some embodiments, illumination assembly 240 is operably coupled to controller 190 (FIG. 3). During operation, light source 242 may thus selectively emit or direct light into storage cavity 214 (e.g., as directed by controller 190), illuminating any ice 203 (FIG. 3) therein.

As illustrated in FIG. 3, a motion sensor 244, such as an infrared sensor, microwave sensor, ultrasonic sensor, etc., may be included on refrigerator appliance 100. Specifically, motion sensor 244 may be in operable communication (e.g., mechanical communication, electrical communication, visual communication, etc.) with outer door 184. In turn, motion sensor 244 may be configured to detect a position or movement of outer door 184 relative to inner door 182. Additionally, motion sensor 244 may be operably coupled to controller 190 to communicate signals or information therewith. In some embodiments, motion sensor 244 may be mounted on inner door 182 (e.g., on or behind external panel 186). Optionally, motion sensor 244 may be mounted on controller 190.

When assembled, motion sensor 244 may generally detect movement of outer door 184 relative to inner door 182 (e.g., between the covered and uncovered positions). For instance, motion sensor 244 may be configured to transmit a detection signal to controller 190 in response to detected movement of the outer door 184 from the covered position. In some such embodiments, controller 190 is further configured to execute a subsequent operation based on or in response to receiving the detection signal. As an example, controller 190 may be configured to activate illumination assembly 240 based on the detection signal from the motion sensor 244. As another example, controller 190 may be configured to activate user interface 148 based on the detection signal from the motion sensor 244.

Figure 11:
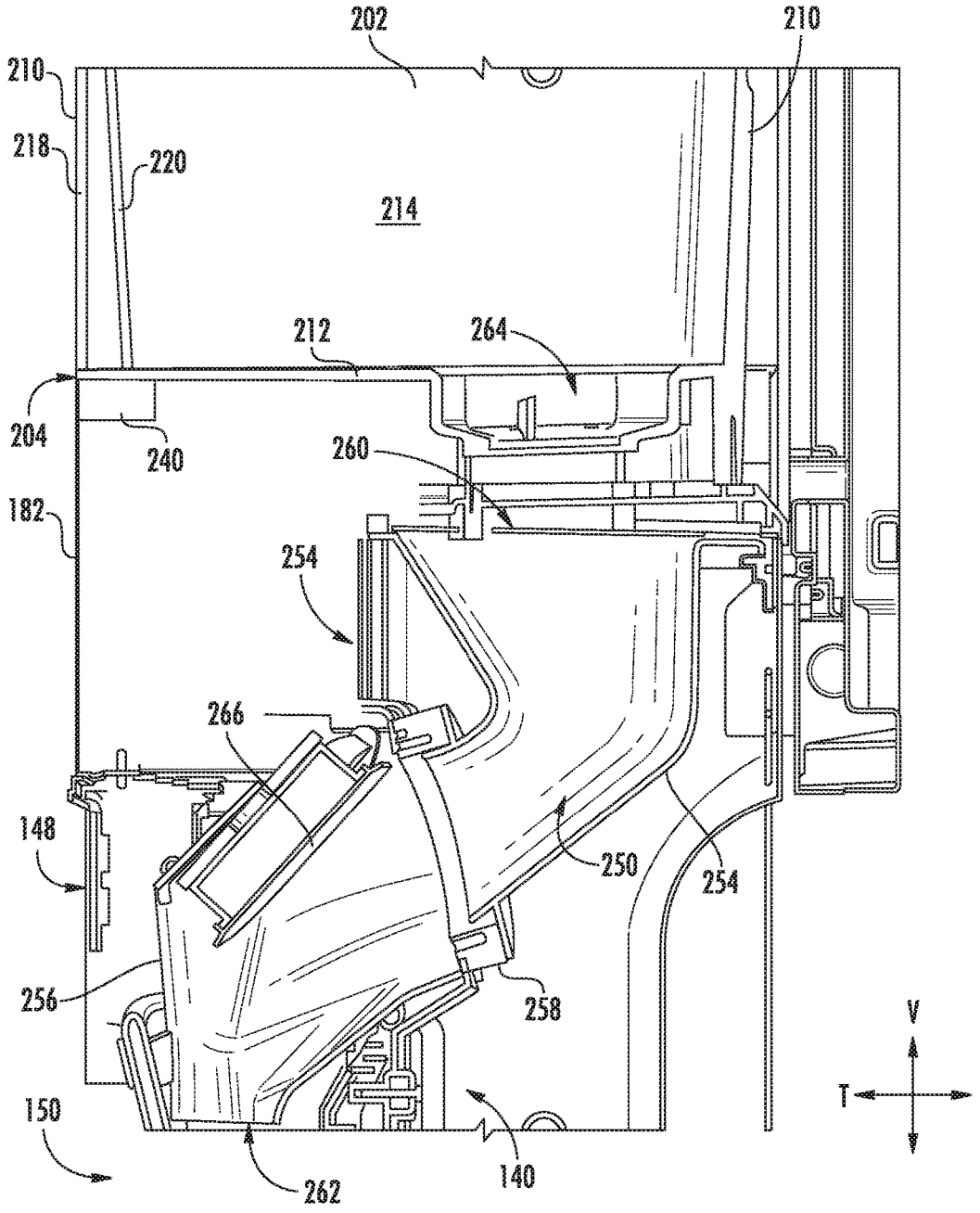
FIG. 11 provides a section view of a dispensing assembly of the example refrigerator appliance of FIG. 1.

Turning now to FIG. 11, a section view of dispensing assembly 140 of refrigerator appliance 100 is provided. As shown, dispensing assembly 140 generally defines an ice delivery passage 250 in communication with storage bin 202 (e.g., in the limiting position). For instance, dispensing assembly 140 may include a dispenser conduit 252 mounted to and/or positioned at least partially within inner door 182. In some such embodiments, dispenser conduit 252 includes a top piece or portion 254 and a bottom piece or portion 256 that are connected or joined together at joint 258. It should be understood that dispenser conduit 252 shown in FIG. 11 is provided by way of example only and that, in alternative example embodiments, dispenser conduit 252 may be formed as a single piece or as more than two pieces, e.g., three, four or more pieces.

In some embodiments, dispenser conduit 252 defines ice delivery passage 250. Ice delivery passage 250 of dispenser conduit 252 is configured for directing ice from ice making assembly 200 to dispenser recess 150. In particular, ice delivery passage 250 of dispenser conduit 252 extends between an inlet 260 and an outlet 262. Inlet 260 of ice delivery passage 250 is positioned at or adjacent ice storage bin 202, and outlet 262 of ice delivery passage 250 is positioned at or adjacent a top portion of dispenser recess 150, e.g., and forms or corresponds to discharging outlet 144 (FIG. 1). Inlet 260 of ice delivery passage 250 may be positioned above outlet 262 of ice delivery passage 250 along the vertical direction V, e.g., such that gravity urges ice nuggets or cubes from ice storage bin 202 into and through ice delivery passage 250 to outlet 262. For instance, ice may be urged through a base aperture 264 defined through base wall 212. From base aperture 264, ice may thus flow to ice delivery passage 250 after passing through inlet 260.

In some embodiments, inlet 260 may also be offset from outlet 262 along a direction that is perpendicular to the vertical direction V, e.g., such that inlet 260 of ice delivery passage 250 is unaligned with outlet 262 of ice delivery passage 250 along the vertical direction V, as shown in FIG. 11. Inlet 260 of ice delivery passage 250 may also have a larger cross-sectional area (e.g., in a plane that is perpendicular to the vertical direction V) than outlet 262 of ice delivery passage 250. Thus, dispenser conduit 252 may funnel ice through ice delivery passage 250 from inlet 260 to outlet 262. Outlet 262 of ice delivery passage 250 may also have a circular shape, e.g., in a plane that is perpendicular to the vertical direction V, in certain example embodiments.

A duct door 266 may be positioned within dispenser conduit 252, e.g., at or adjacent the joint 258 between top portion 254 and bottom portion 256 of dispenser conduit 252. Duct door 266 is selectively adjustable (e.g., rotatable) between an unobstructed position (shown in FIG. 11) and an obstructed position. In the obstructed position, duct door 266 is positioned between dispenser recess 150 and icebox compartment 160 (FIG. 2). Thus, duct door 266 may obstruct or hinder air flow between dispenser recess 150 and icebox compartment 160 (FIG. 2) and reduce heat transfer between dispenser recess 150 and icebox compartment 160. Conversely, in the unobstructed position, duct door 266 is not positioned between dispenser recess 150 and icebox compartment 160. Thus, ice from storage cavity 214 may flow through ice delivery passage 250 to outlet 262 of ice delivery passage 250 without impacting duct door 266. Duct door 266 may normally be in the obstructed position and may shift to the unobstructed position when a user operates an actuating mechanism or otherwise directs dispenser assembly 140 to dispense ice.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a chilled chamber;

a door defining a bin opening and a dispenser recess, the door being rotatably hinged to the cabinet to rotate between a closed position restricting access to the chilled chamber and an open position permitting access to the chilled chamber;

a dispensing assembly positioned within the dispenser recess and defining an ice delivery passage;

an icemaker attached to the cabinet;

an ice storage bin defining a storage cavity in selective communication with the icemaker to receive ice therefrom, the ice storage bin being in further communication with the dispensing assembly to direct ice to the ice delivery passage, the ice storage bin being mounted to the door at the bin opening, the ice storage bin being selectively accessible through the bin opening in the closed position, the storage bin being movably attached to the door to move between a limiting position restricting access to the storage cavity and an ajar position permitting access to the storage cavity; and an illumination assembly mounted to the door, the illumination assembly comprising a light source positioned below the storage bin and directed toward the storage cavity in the limiting position.

2. The refrigerator appliance of claim 1, wherein the storage bin is pivotally attached to the door to move between the limiting position restricting access to the storage cavity and the ajar position permitting access to the storage cavity.

3. The refrigerator appliance of claim 1, wherein the bin opening is defined above the dispenser recess along a vertical direction.

4. The refrigerator appliance of claim 1, wherein the storage bin comprises a transparent front panel selectively positioned across the bin opening.

5. The refrigerator appliance of claim 1, wherein the storage bin comprises an insulated sidewall at least partially defining the storage cavity, the sidewall comprising a front panel and a rear panel defining a transparent insulation gap therebetween.

6. The refrigerator appliance of claim 1, wherein the icemaker is mounted above the storage bin along a vertical direction.

7. The refrigerator appliance of claim 1, wherein the door is an inner door, and wherein the refrigerator appliance further comprises an outer door rotatably hinged to the inner door and selectively disposed across the bin opening.

8. The refrigerator appliance of claim 7, wherein the outer door comprises a planar internal surface selectively disposed across an external panel of the inner door.

9. The refrigerator appliance of claim 7, further comprising a motion sensor in operable communication with the outer door to detect movement of the outer door relative to the inner door.

10. The refrigerator appliance of claim 9, wherein the storage bin is movably attached to the inner door to move between the limiting position restricting access to the storage cavity and the ajar position permitting access to the storage cavity, the refrigerator assembly further comprising a controller operably coupled to the motion sensor to receive a detection signal therefrom, wherein the illumination assembly is operably coupled to the controller, and wherein the controller is configured to activate the illumination assembly based on the detection signal from the motion sensor.

11. A refrigerator appliance comprising:

a cabinet defining a chilled chamber;

an inner door defining a bin opening and a dispenser recess below the bin opening, the inner door being rotatably hinged to the cabinet to rotate between a closed position restricting access to the chilled chamber and an open position permitting access to the chilled chamber, the inner door comprising an external panel positioned about the bin opening and the dispenser recess;

an outer door rotatably hinged to the inner door to rotate between a covered position restricting access to the dispenser recess in the closed position of the inner door and an uncovered position permitting access to the dispenser recess in the closed position of the inner door;

a dispensing assembly positioned within the dispenser recess and defining an ice delivery passage;

an icemaker attached to the cabinet; and an ice storage bin defining a storage cavity in selective communication with the icemaker to receive ice therefrom, the ice storage bin being further in communication with the dispensing assembly to direct ice to the ice delivery passage, the ice storage bin being mounted to the inner door and through the external panel of the inner door at the bin opening, the ice storage bin being selectively accessible through the bin opening, wherein the outer door comprises a planar internal surface positioned forward from the external panel of the inner door, wherein the planar internal surface of the outer door extends across the bin opening, the dispenser recess, and the external panel of the inner door in the covered position, and wherein the outer door further comprises a solid external surface defined opposite of the planar internal surface of the outer door.

12. The refrigerator appliance of claim 11, wherein the storage bin is pivotally attached to the inner door to move between a limiting position restricting access to the storage cavity and an ajar position permitting access to the storage cavity.

13. The refrigerator appliance of claim 11, wherein the bin opening is defined above the dispenser recess along a vertical direction.

14. The refrigerator appliance of claim 11, wherein the storage bin comprises a transparent front panel selectively positioned across the bin opening.

15. The refrigerator appliance of claim 11, wherein the storage bin is movably attached to the inner door to move between a limiting position restricting access to the storage cavity and an ajar position permitting access to the storage cavity, the refrigerator assembly further comprising an illumination assembly mounted to the inner door, the illumination assembly comprising a light source positioned below the storage bin and directed toward the storage cavity in the limiting position.

16. The refrigerator appliance of claim 11, wherein the storage bin comprises an insulated sidewall at least partially defining the storage cavity, the sidewall comprising a front panel and a rear panel defining a transparent insulation gap therebetween.

17. The refrigerator appliance of claim 11, further comprising a motion sensor in operable communication with the outer door to detect movement of the outer door from the covered position.

18. The refrigerator appliance of claim 17, further comprising a controller operably coupled to the motion sensor to receive a detection signal therefrom; and an illumination assembly mounted to the inner door and operably coupled to the controller, wherein the controller is configured to activate the illumination assembly based on the detection signal from the motion sensor, and wherein the illumination assembly comprises a light source positioned below the storage bin and directed toward the storage cavity.

* * * * *